US006263866B1

(12) United States Patent
Tsao

(10) Patent No.: US 6,263,866 B1
(45) Date of Patent: Jul. 24, 2001

(54) STONE CUTTER

(76) Inventor: Wen-Hai Tsao, No.56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/487,918

(22) Filed: Jan. 18, 2000

(51) Int. Cl.[7] ..... B28D 1/04
(52) U.S. Cl. ..... 125/13.01; 125/35; 451/454
(58) Field of Search ..... 125/13.01, 35; 451/488, 450, 454, 455

(56) References Cited

U.S. PATENT DOCUMENTS 4,940,038 * 7/1990 O'Keefe ..... 125/35
5,676,124 * 10/1997 Lee ..... 125/13.01
6,000,387 * 12/1999 Lee ..... 125/13.01
6,152,127 * 11/2000 Fuhrman et al. ..... 125/35

* cited by examiner

*Primary Examiner*—Robert A. Rose

(57) ABSTRACT

A stone cutter has a sink standing upon a callapible support, a frame disposed on the sink including an upright at a corner portion and a guide rod longitudinally secured in the frame, a platform including a tubular slider of splined inner periphery sliding on the guide rod and plurality of pulleys on the other side slidable on the frame, a housing including a sleeve sleeved on the upright of the frame, a switch, an indicator transversely disposed in the housing positioned opposite to the sleeve, a saw blade secured to an axis of the motor and a casing covering the upper portion of the saw blade having one end rotatably secured to the housing and a pair of water suppliers on two side to provide water to clean the dust from a working piece during the operation of the stone cutter.

2 Claims, 10 Drawing Sheets

STONE CUTTER

BACKGROUND OF THE INVENTION

The present invention relates to cutters and more particularly to a stone cutter which is easily to operate and conveniently to move.

Typical stone cutter 10 (as shown in FIGS. 1,2 and 3) includes a sink 11, a frame 12 disposed on the shoulder 111 of the sink 11, a guide rod longitudinally secured to the frame 12, a slider 123 sliding on the guide rod 121, a plateform 17 having one end secured to the slider 123 and the other end secured to a pulley set 124 which is slidable on a longitudinal plate 122 of the frame 12, a roughly L-shaped reinforcement 13 having one end integrated with the frame 12 and the other end screwed to a trapezoid upright 14 above the frame 12, a motor 15 having on lower end screwed to the upright 14 and connected to a saw blade 16 on the other side of the upright opposite to the motor 15 and a casing 161 covering the blade 16 and having one end 164 secured to the outer end of the upright 14 by screw 162 and the other end 163 releasibly disposed to a slot 142 on the inner end of the upright 12. This type of stone cutter 10 has the disadvantages set forth as follows:

a) the motor 15 is vertically disposed on the upright 14 and difficult to disassemble so as to be inconveniently to move, b) the inner end 163 is abstrused by the motor 15 so that the opening span of the casing 161 is limited therefore causing difficult to change the saw blade 16, c) the saw blade 16 is unadjustable vertically so that it could not cope with the thickness of the working object, d) which the slider 123 is contaminated with sawdust, the plateform 17 will not smoothly slidable.

The present invention will become more fully understood by reference to the following detailed description thereof when read in conjunction with the attached drawings.

DETAILED DESCRIPTION OF THE PREFERRED EMBODIMENT

Figure 1:
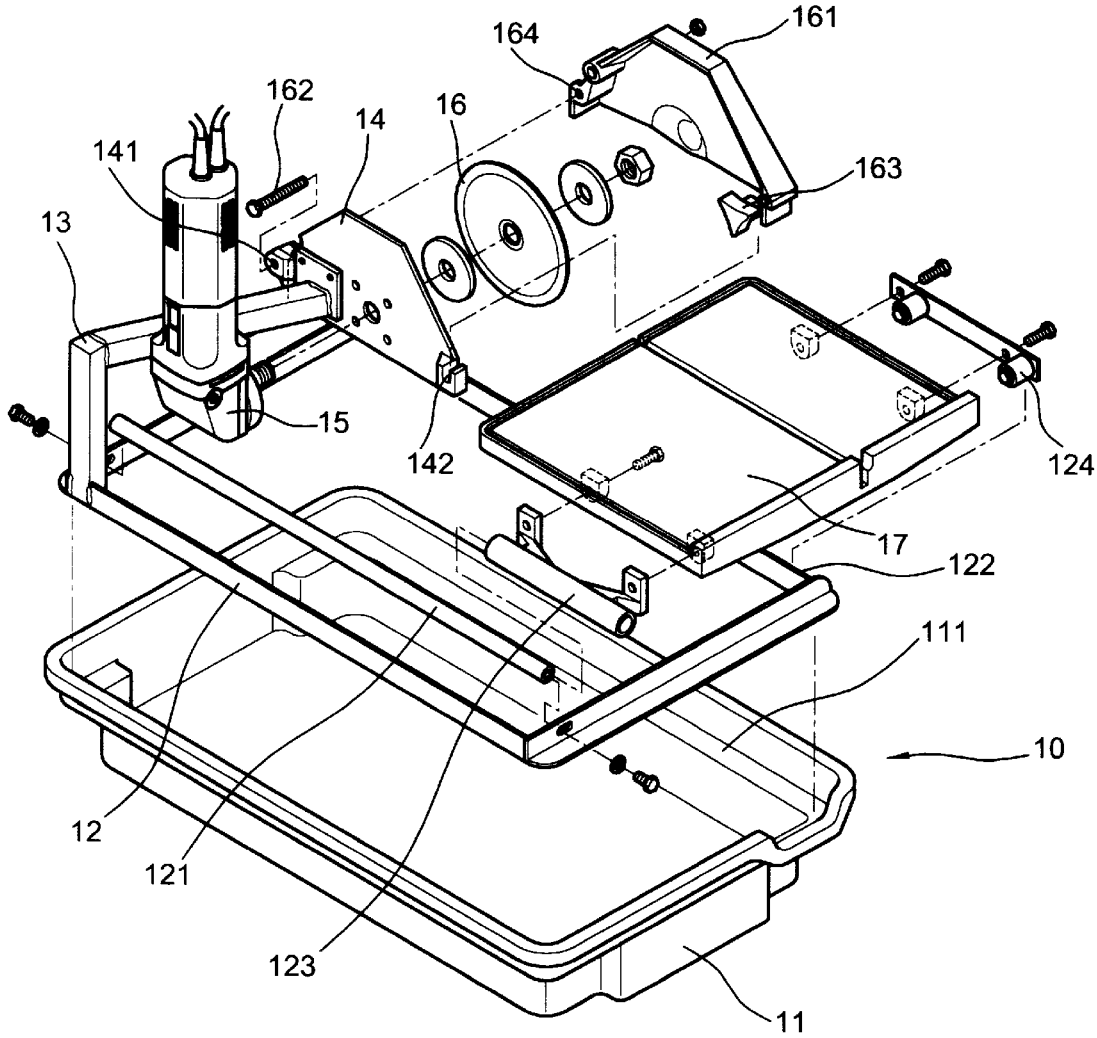
FIG.1 Prior Art
FIG. 1 is an exploded perspective view of a stone cutter according to a prior art.
Figure 2:
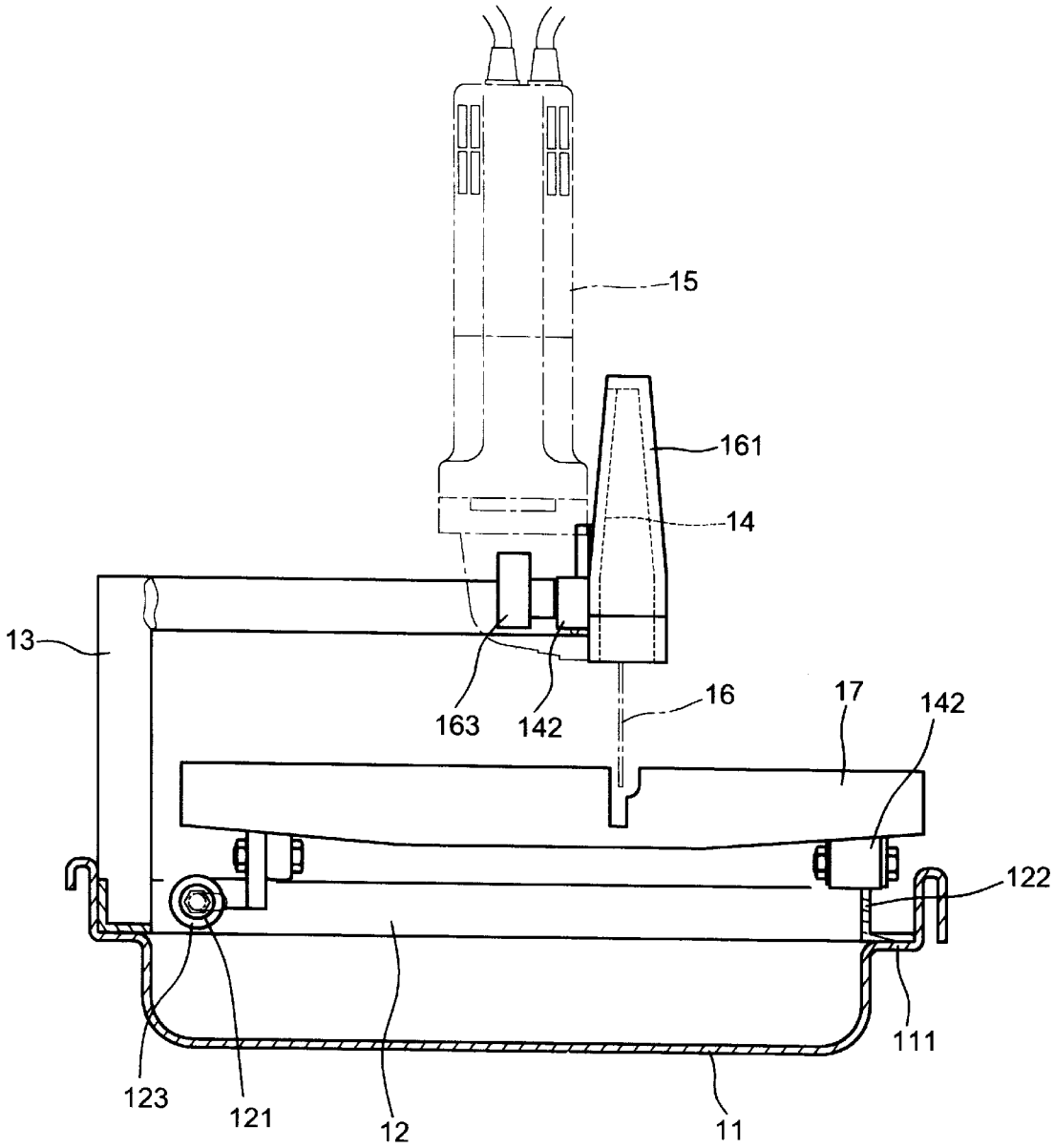
FIG.2 Prior Art
FIG. 2 is a rear side view of an assemblage of FIG. 1.
Figure 3:
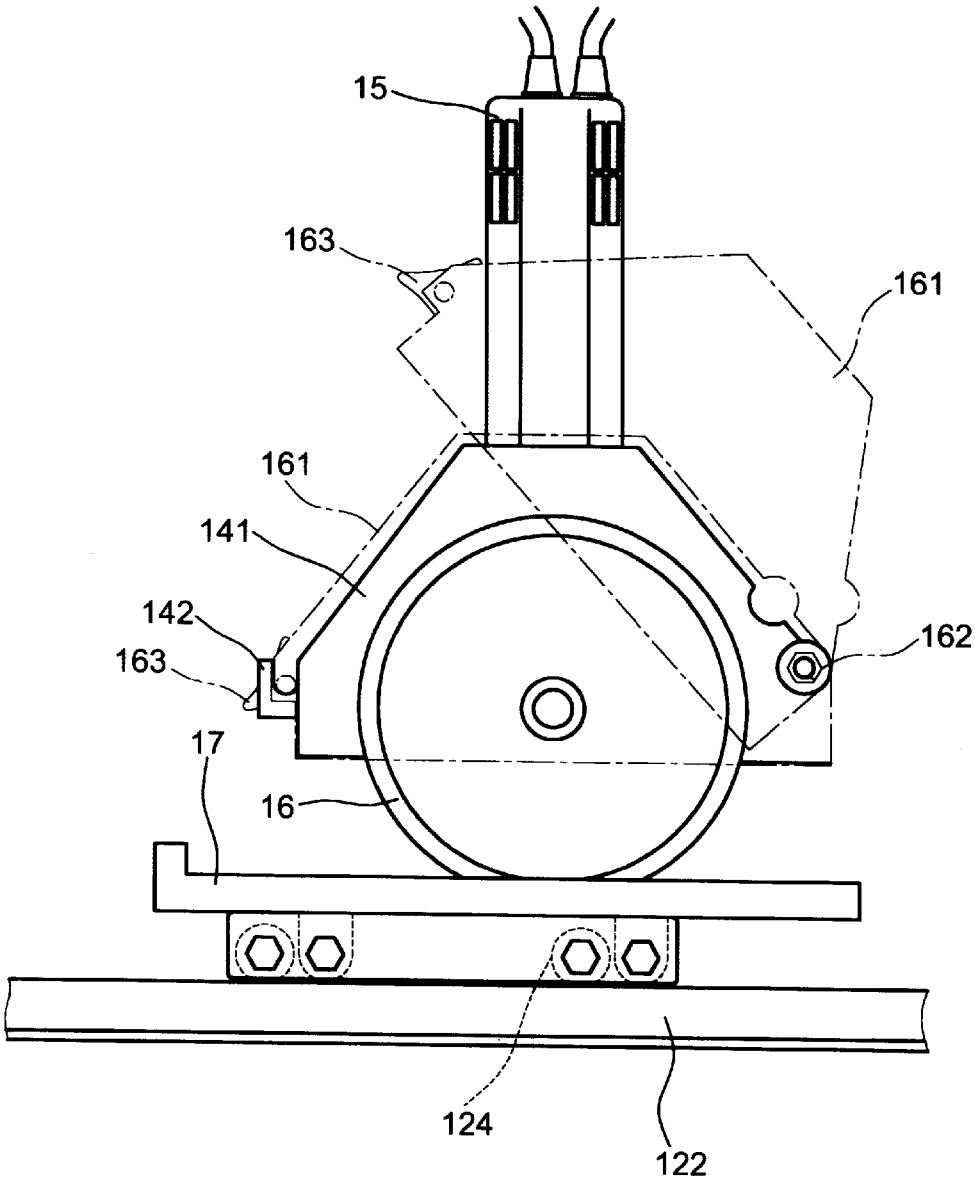
FIG.3 Prior Art
FIG. 3 is a lateral side view of FIG. 2 indicating the operation of a casing.
Figure 4:
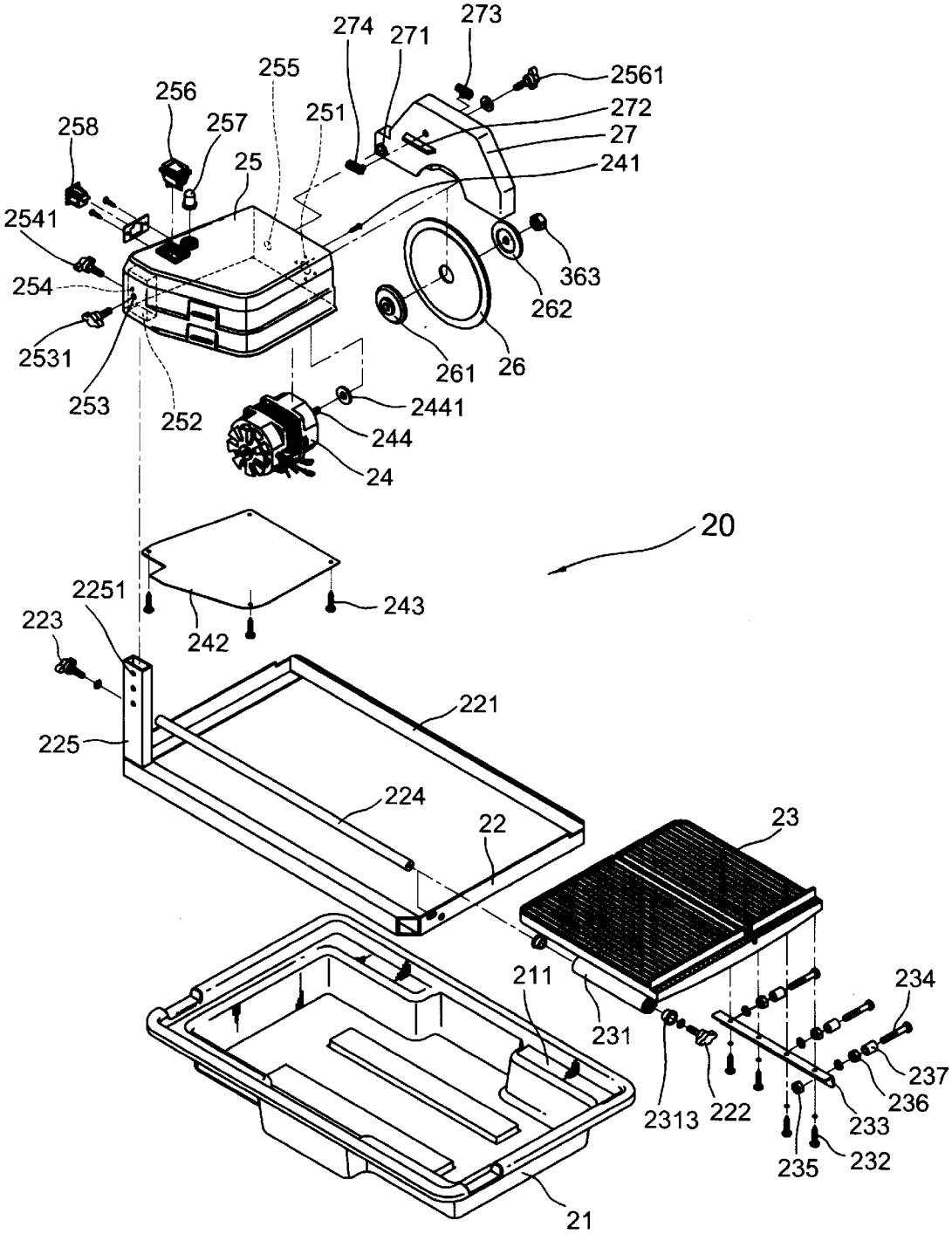
FIG. 4 is an exploded perspective view to show a preferred embodiment of the stone cutter according to the present invention.
Figure 5:
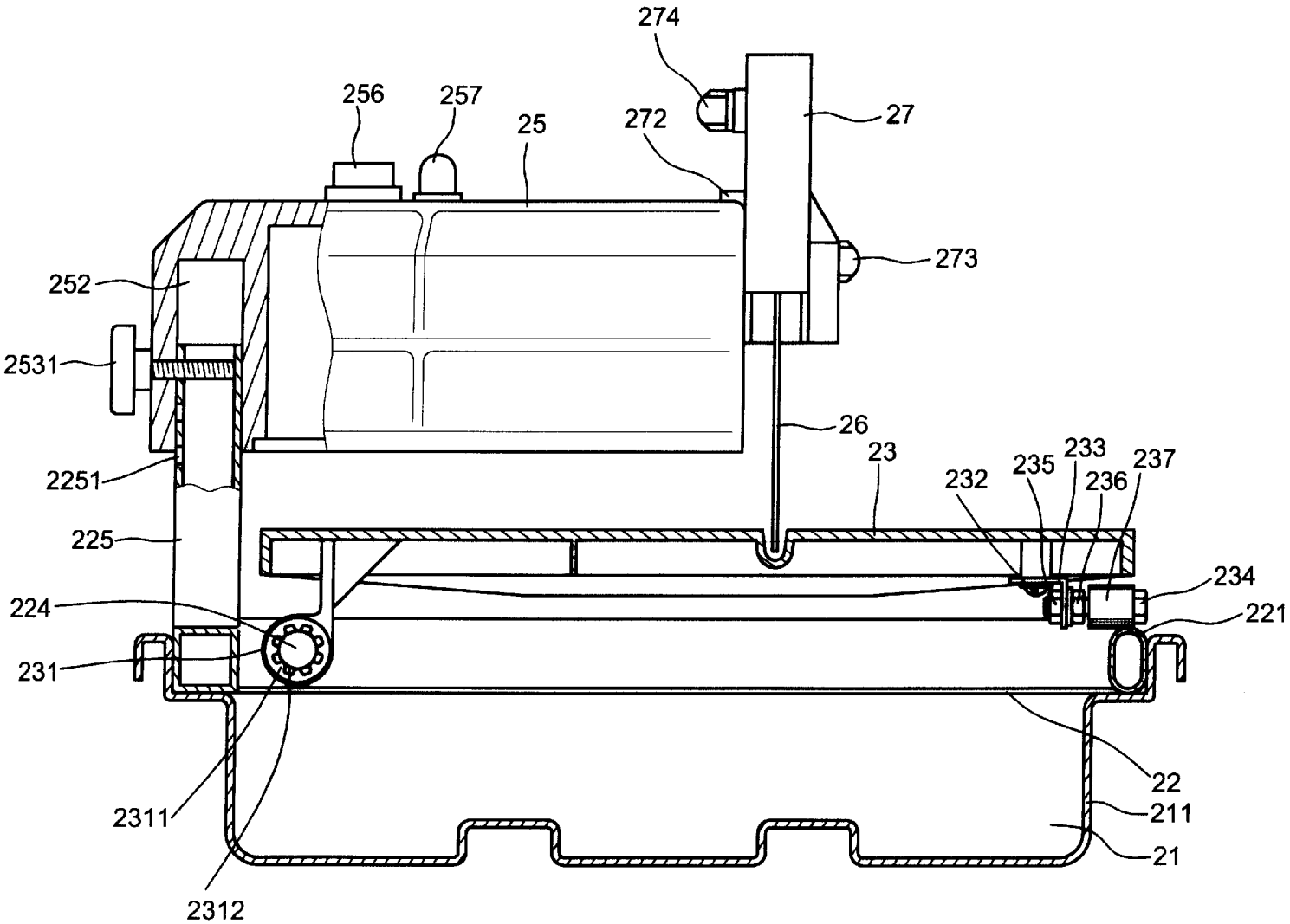
FIG. 5 is an elevational view to show an assemblage of FIG. 4.
Figure 6:
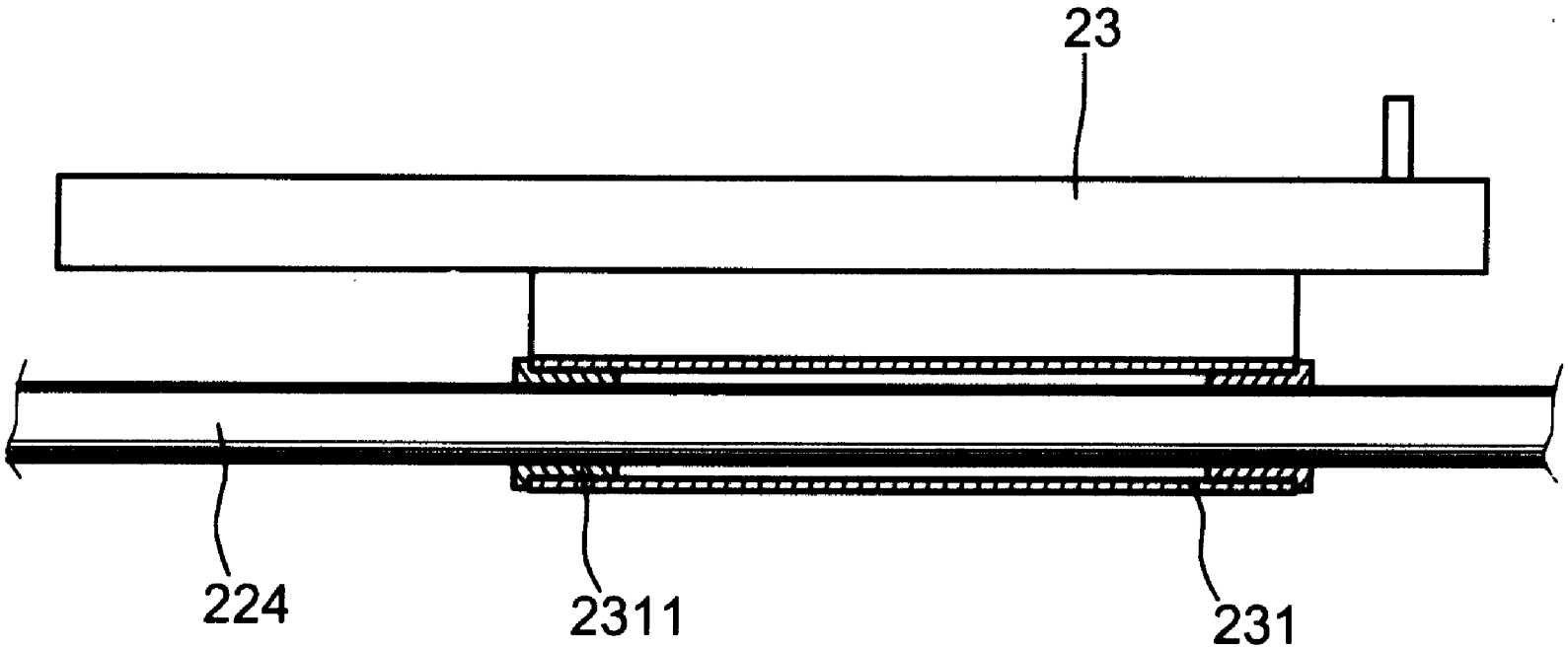
FIG. 6 is a side view and partially sectional view of show a slider of the present invention.
Figure 9:
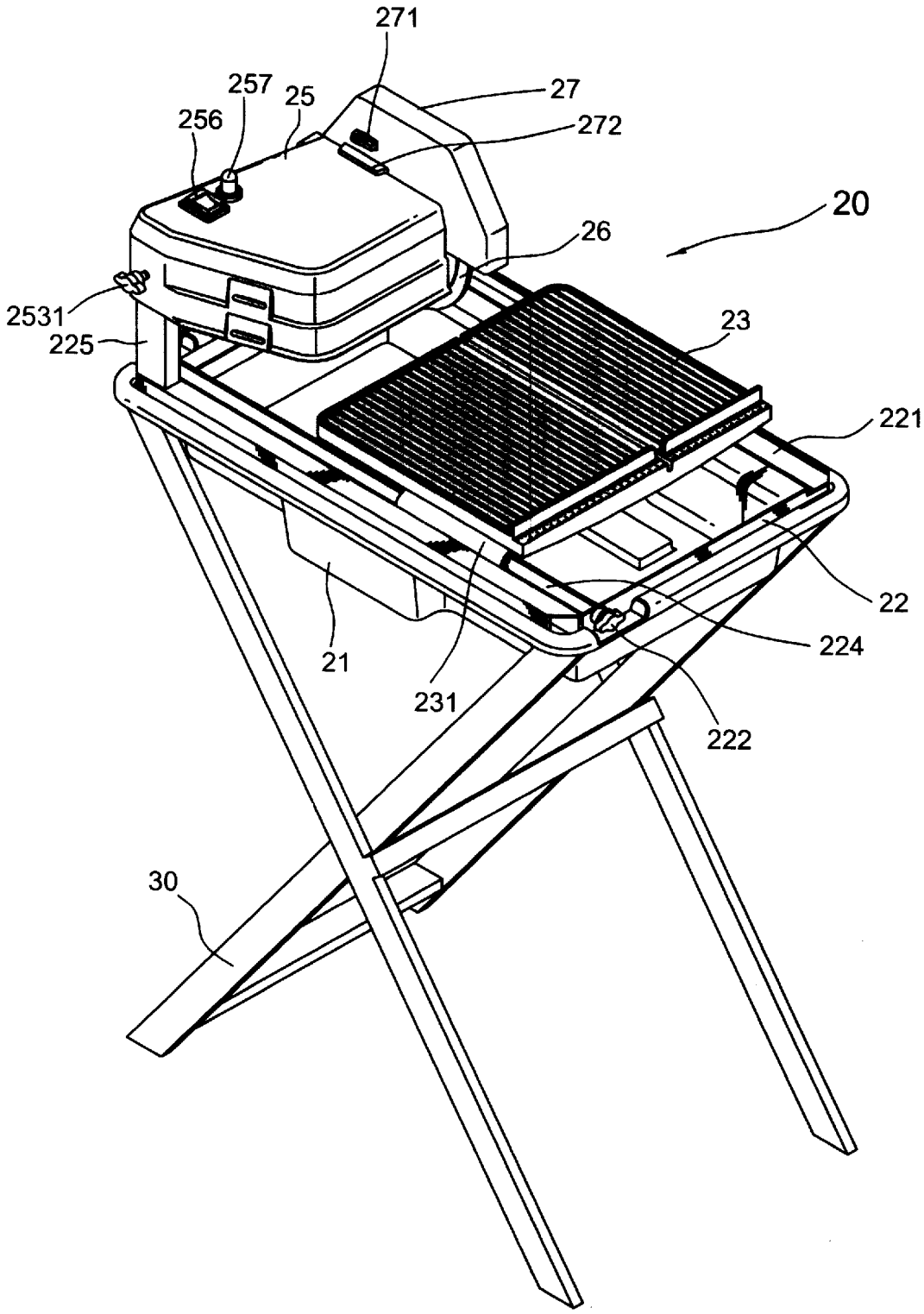
FIG. 9 is a perspective view to show an outlook of the preferred embodiment of the present invention.

With reference to FIGS. 4, 5 and 6 of the drawings, the preferred embodiment of the stone cutter 20 of the present invention comprises generally a sink 21 standing on a collapsible support 30 (as shown in FIG. 9), a frame 22 releasibly disposed on the shoulder 211 of the sink 21, a platform 23, a motor 24, a housing 25, a saw blade 26 and a casing 27.

The 21 Which is provided to take in the filthy water and saw dust has shoulders therearound for supporting the frame 22.

The frame 22 has a rail plate 221 of arcuate surface on one of the longitudinal side, a guide 224 longitudinally and adjustably secured to the frame 22 by bolts 222 and 223 and washers and an upright 225 projected upward from a corner portion of the frame including a plurality transverse screw holes 2251 spacedly formed in upper portion.

The platform 23 has a tubular slider 231 integrated on one side which is slidably wrapped on the guide rod 224 of the frame 22 and has plurality of longitudinal splines 2311 of round surface around inner periphery and a pair of annular caps 2313 covering two ends, this arrangement facilitates the smooth sliding of the slider 231 on the guide rod 224 and prevents the saw dust from entering into the slider 231, if some of the saw dust is supposedly entered into the slider 231, they will be accepted in the gaps 2312 between the splines 2311, a positioning plate 233 of L-shaped section secured to the other side of the platform by screws 232 and a plurality of pulleys 237 spacedly and rotatably to a vertical portion of the positioning plate 233 by bolts 234, nuts 235 and 236 respectively, the pulleys 237 are slidable on the rail plate 221.

The housing 25 of a roughly rectangular configuration has a sleeve 252 formed in a corner portion sleeved on the upright 225 of the frame 22 and adjustably secured by bolts 2531 and 2541 through the screw holes 253, 254 and 2251, a switch 256 with an indicator 257 secured on the top of the housing 25 adjacent the sleeve 253, a plug 258 secured on an outer wall of the housing 25 abutting the switch.

The motor 24 is transversely disposed inside the housing 25 abutting an outerwall opposite to the sleeve 253 and secured by screws 241 through the screw holes 251 with its axis 244 extruded from an aperture the housing 25.

A bottom 242 covers the underside of the housing 25 and secured by screws 243.

The saw blade 26 is rotatably secured to the axis 244 of the motor 24 by nut 263 with a pair washers 262 and 261 disposed therebewteen.

The casing releasibly covers the upper portion of the motor 24 and has on outer end rotatably secured to the housing 25 by bolt 2561 through the screw holes 271 and 255, a check plate 272 formed on an inner wall of the casing 27 for stopping the casing 27 on a top of the housing 25 to keep the casing 27 to be normally horizontal and a pair of water pipes respectively secured to the opposing side walls of the casing 27 for providing the water to the working piece from an external water source (not shown) during the operation of the stone cutter 20 in order to cooling the saw blade 26 and washing the dust from the working piece.

Based on the above arrangement, the platform 23 can be turned over on the guide rod 224 and the housing 25 is vertically adjustable and readily removable from the upright 225 for transportation.

Figure 7:
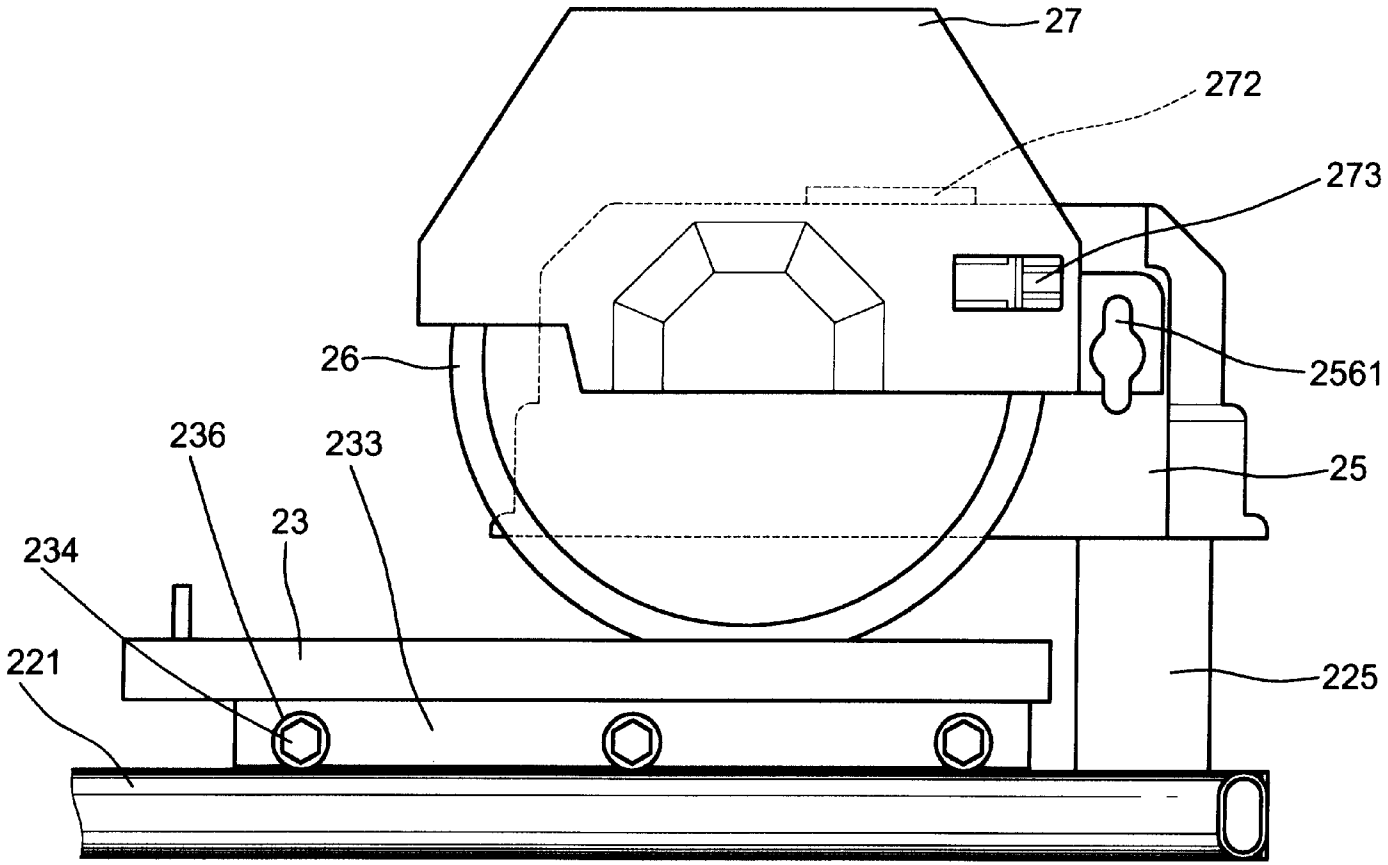
FIG. 7 is a side view of FIG. 5.
Figure 8:
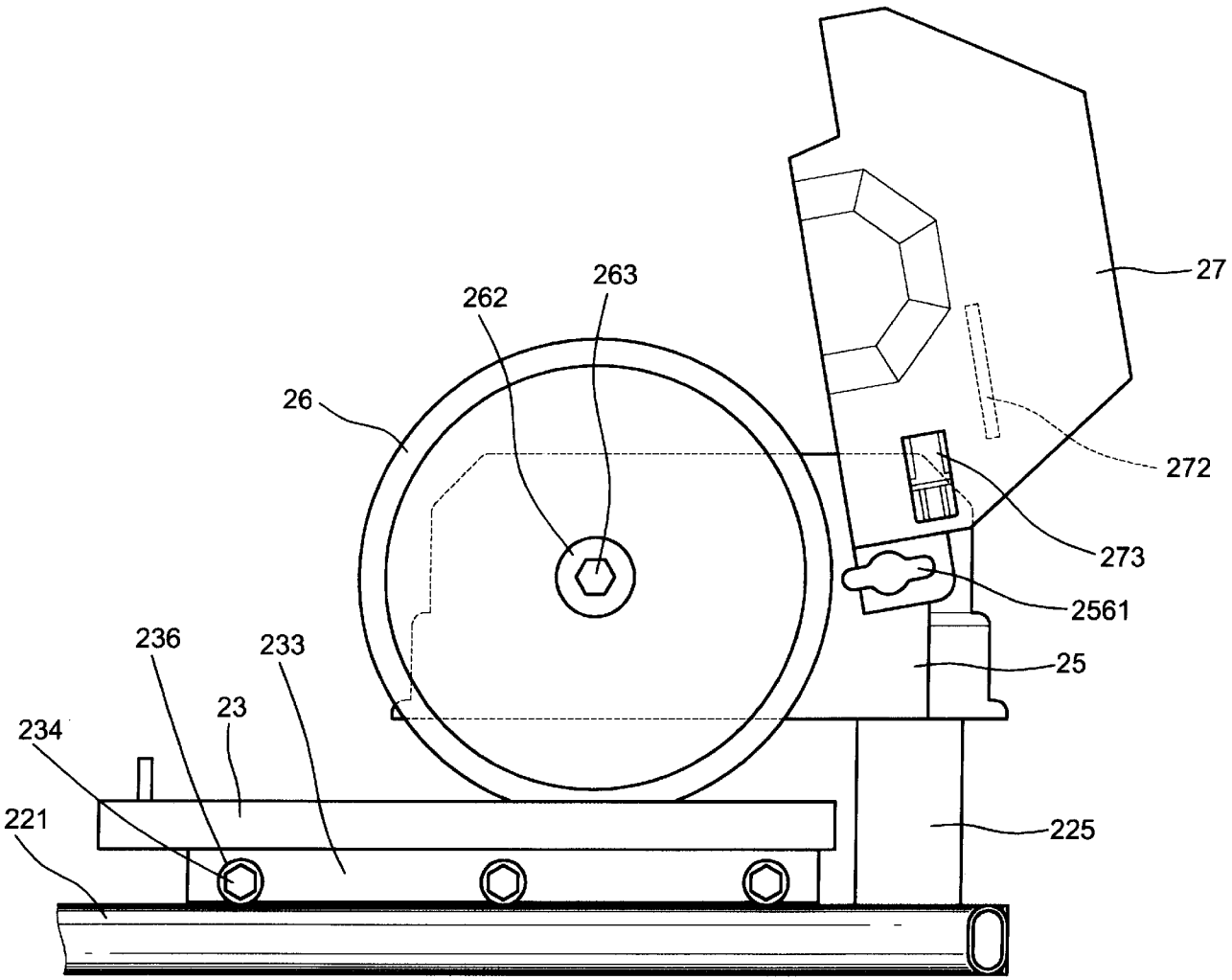
FIG. 8 is a side view indicating the operation of a casing.

Referring to FIGS. 7 and 8 when changing the saw blade 26, first unfasten the bolt 2561 to free the casing 27 which can turn upward for about 180° about the bolt 2561, so that the saw blade is readily changed without any obstacle. FIG. 9 shows an outlook of preferred embodiment of the stone cutter 20 according to the present invention.

Figure 10:
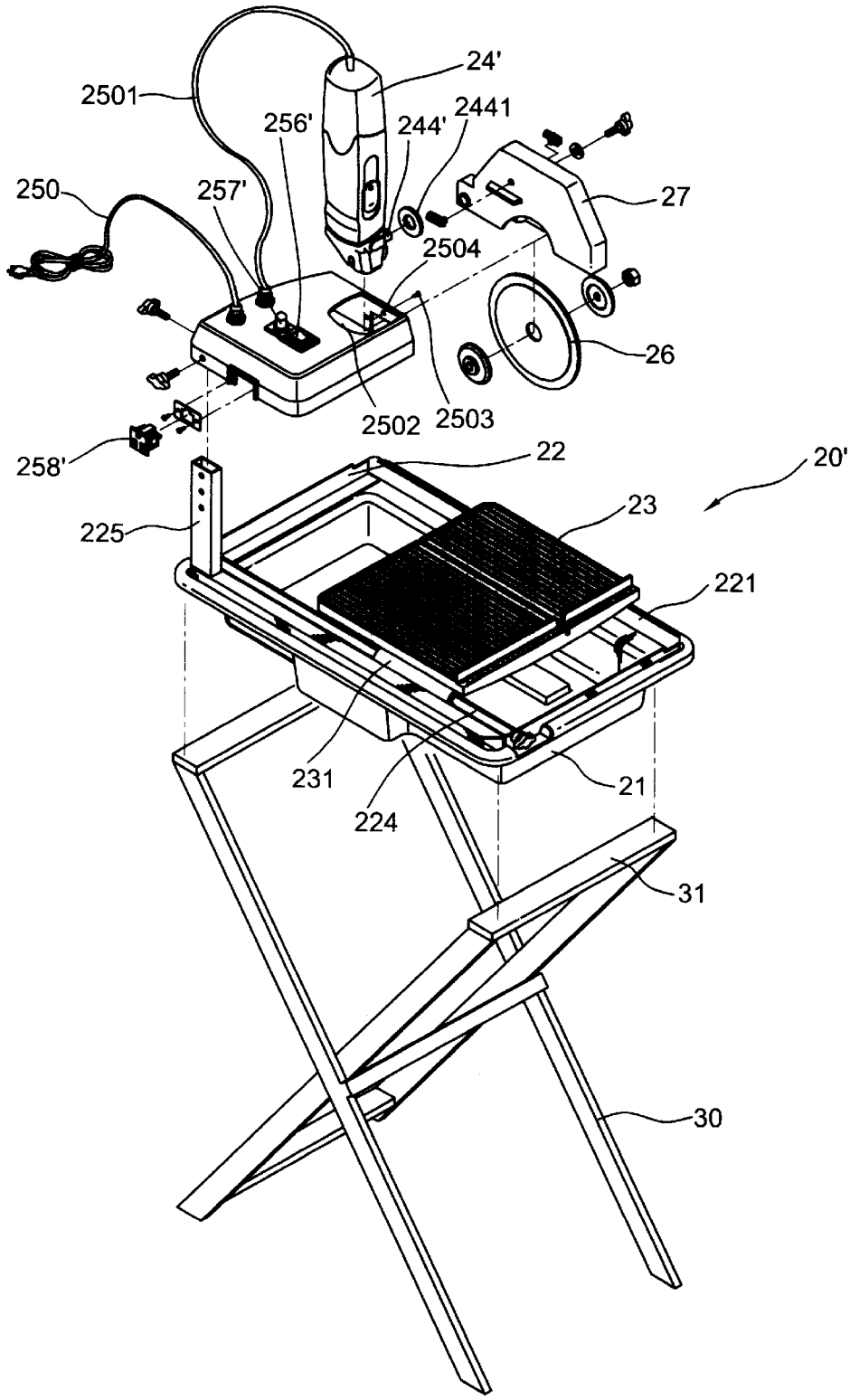
FIG. 10 is an exploded perspective view to show an alternatively embodiment of the present invention.

Referring to FIG. 10, an alternative embodiment of the stone cutter 20' of the present invention is provided. This embodiment is structurally and functionally most similar to the that described the above in FIGS. 4–9 and the above discussions are applicable in the most instances. The only difference is that the motor 24 is replaced with a vertical motor 24' which is inserted into the housing 25' from an opening 2502 in a top of the housing 25' inner than that housing 25 and secured by screws 2503 through the screw hole 2504. The motor 24' includes a transverse axis 244' connected to the saw blade 26 in the manner as discussed the above. A first wire 250 connects respectively to an external power source (not shown) and a switch 257' and a indicator 256' which is positionally inner than that of the switch 257 and the indicator 256 relative to the housing 25'. A second wire 2501 connected respectively to the switch 257' and the motor 24'. Further, a plug 258' located at a lateral side of the housing 25' instead of the plug 258 located at an outer side of the housing 25. Upon this change, the stone cutter 20' is operable as that of the stone cutter 20 of the above embodiment.

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A stone cutter comprising:

a sink standing on a collapsible support and having a plurality of shoulders around inner periphery thereof;

a frame disposed on the shoulders of said sink and having an upright projected upward from a corner portion thereof including a plurality of screw holes spacedly and longitudinally formed in an upper portion, a rail of arcuate upper surface disposed on a longitudinal side of the frame opposite to the upright and a guide rod longitudinally secured in the frame by means of a bolt and positioned adjacent the upright;

a platform slidably disposed on said frame and having tubular slider integrated with one side thereof slidably wrapped on the guide rod of said frame, said slider having a plurality of round top spacedly and longitudinally formed on inner periphery to define a plurality of gaps therebetween and a pair of annular caps covering two ends thereof; a positioning plate of L-shaped section secured to other side of the platform by means of screws and opposite to the slider, and a plurality of pulleys slidably and transversely secured to an outer side of the positioning plate by means of screws, said pulleys being slidable on the rail of said frame;

a housing of rectangular configuration having four side walls, a closed top, a releasible bottom secured by means of screws, a sleeve formed in a corner portion engageable onto the upright of said frame and adjustably secured by means of bolts including a plurality longitudinal screw holes formed spaced apart and engageably with the screw holes of the upright, a switch together with an indicator disposed on the top of the housing adjacent the sleeve, a plug disposed to an outer wall of the housing abutting the switch, a plurality of screw holes around an aperture formed in a side wall opposite to the sleeve and a single screw hole in the side wall and positioned spaced apart from the aperture;

a motor transversely disposed into said housing abutting the aperture and secured to the housing by means of screws through the screw holes around the aperture, said motor having an axis extruded from the aperture;

a saw blade secured to the axis of said motor by means of nut with a pair washers engaged therebetween;

a casing covering upper portion of said saw blade and having an outer end rotatably secured to the single screw hole of said housing by means of bolt, a check plate transversely formed on an inner side being able to stop against a top of said housing to keep the casing to be horizontal and a pair of water supplier disposed on two lateral side of the casing respectively for supplying water to clean dust from a working piece.

2. A stone cutter comprising:

a sink standing on a collapsible support and having a plurality of shoulders around inner periphery thereof;

a frame disposed on the shoulders of said sink and having an upright projected upward from a corner portion thereof including a plurality of screw holes spacedly and longitudinally formed in an upper portion, a rail of arcuate upper surface disposed on a longitudinal side of the frame opposite to the upright and a guide rod longitudinally secured in the frame by means of a bolt and positioned adjacent the upright;

a platform slidably disposed on said frame and having tubular slider integrated with one side thereof slidably wrapped on the guide rod of said frame, said slider having a plurality of round top spacedly and longitudinally formed on inner periphery to define a plurality of gaps therebetween and a pair of annular caps covering two ends thereof; a positioning plate of L-shaped section secured to other side of the platform by means of screws and opposite to the slider, and a plurality of pulleys slidably and transversely secured to an outer side of the positioning plate by means of screws, said pulleys being slidable on the rail of said frame;

a housing of thin rectangular configuration having four side walls, a closed top and bottom, a sleeve formed in a corner portion engageable onto the upright of said frame and adjustably secured by means of bolts including a plurality longitudinal screw holes formed spaced apart and engageably with the screw holes of the upright, a switch together with an indicator disposed on a central top of the housing a plug disposed to an outer wall of the housing adjacent the sleeve, a plurality of screw holes around an aperture formed in a side wall opposite to the sleeve a single screw hole in the side wall and positioned spaced apart from the aperture, an opening formed in a top above the aperture, a first electrical wire having one end connected to the switch and other end to an external power source and a second electrical wire having one end connected to the switch;

a motor vertically disposed into the opening of said housing abutting the aperture and secured to the housing by means of screws through the screw holes around the aperture, said motor having a transverse axis extruded from the aperture and connected to other end of said second electrical wire;

a saw blade secured to the axis of said motor by mean of nut with a pair washers engaged therebetween;

a casing covering upper portion of said saw blade and having an outer end rotatably secured to the single screw hole of said housing by means of bolt, a check plate transversely formed on an inner side being able to stop against a top of said housing to keep the casing to be horizontal and a pair of water supplier disposed on two lateral side of the casing respectively for supplying water to clean dust from a working piece.

* * * * *